US008118241B2

(12) United States Patent
Gardner et al.

(10) Patent No.: US 8,118,241 B2
(45) **Date of Patent: *Feb. 21, 2012**

(54) SURFACE CLEANER SYSTEM

(75) Inventors: Michael Robert Gardner, Anderson, SC (US); Klaus Karl Hahn, Braselton, GA (US); Charles Keith Long, Seneca, SC (US)

(73) Assignee: Techtronic Outdoor Products Technology Limited, Hamilton (BM)

( * ) Notice: Subject to any disclaimer, the term of this patent is extended or adjusted under 35 U.S.C. 154(b) by 286 days.

This patent is subject to a terminal disclaimer.

(21) Appl. No.: 12/429,658

(22) Filed: Apr. 24, 2009

(65) Prior Publication Data

US 2009/0223541 A1 Sep. 10, 2009

Related U.S. Application Data

(63) Continuation-in-part of application No. 11/376,610, filed on Mar. 14, 2006, now Pat. No. 7,891,036.

(60) Provisional application No. 61/047,655, filed on Apr. 24, 2008, provisional application No. 60/664,665, filed on Mar. 18, 2005.

(51) Int. Cl.
*B05B 1/20* (2006.01)

(52) U.S. Cl. ..... 239/176; 239/289; 239/146; 134/176

(58) Field of Classification Search ..... 239/289, 239/146, 754, 172, 176; 134/170–174, 176, 134/179, 180

See application file for complete search history.

(56) References Cited

U.S. PATENT DOCUMENTS

| | | | | |
|---|---|---|---|---|
| 1,884,871 | A | 10/1932 | Riebel, Jr. | |
| 3,331,090 | A | 7/1967 | Reiber et al. | |
| 3,939,527 | A | 2/1976 | Jones | |
| 3,977,602 | A | 8/1976 | Kirch | |
| 4,168,562 | A | 9/1979 | Maasberg | |
| 4,191,589 | A | 3/1980 | Halls et al. | |
| 4,377,018 | A | 3/1983 | Cain | |
| 4,766,638 | A | 8/1988 | McDowell | |
| 4,895,179 | A | 1/1990 | Hart | |
| 4,903,364 | A | 2/1990 | Long | |
| 4,913,345 | A | 4/1990 | Setter | |
| 4,984,746 | A * | 1/1991 | Joyal | 239/722 |
| 5,004,156 | A * | 4/1991 | Montanier | 239/130 |
| 5,028,004 | A | 7/1991 | Hammelmann | |
| 5,135,015 | A | 8/1992 | Young | |
| 5,265,805 | A | 11/1993 | Artenian | |
| 5,312,044 | A | 5/1994 | Eaton | |

(Continued)

*Primary Examiner* — Dinh Nguyen
*Assistant Examiner* — Jennifer Gordon
(74) *Attorney, Agent, or Firm* — Michael Best & Friedrich LLP

(57) ABSTRACT

A surface cleaner system includes a base assembly having a housing movable along a surface, a pump supported by the housing and operable to pressurize a fluid, and a prime mover supported by the housing. The prime mover is coupled to the pump to drive the pump. The surface cleaner system also includes a spray assembly coupled to the housing. The spray assembly is operable to discharge fluid from the pump toward the surface. The surface cleaner system further includes a spray gun in fluid communication with the pump to receive pressurized fluid from the pump. The spray gun includes an outlet portion that is connectable to the base assembly to direct the pressurized fluid from the pump into the spray assembly. When the outlet portion is disconnected from the base assembly, the spray gun discharges the pressurized fluid from the pump toward the surface without directing the pressurized fluid into the spray assembly.

28 Claims, 12 Drawing Sheets

U.S. PATENT DOCUMENTS 5,421,520 A 6/1995 Simonette et al.
5,456,412 A 10/1995 Agee
5,494,414 A 2/1996 Steinhart et al.
5,538,402 A 7/1996 McKenney
D375,591 S 11/1996 Fryoux
5,601,659 A 2/1997 Rohrbacher
5,669,558 A 9/1997 Ichel
5,970,574 A 10/1999 Thrash, Jr.
6,012,645 A 1/2000 Poppitz
6,032,326 A 3/2000 Roden et al.
6,158,678 A 12/2000 Lange
6,267,308 B1 7/2001 Hall
6,295,692 B1 10/2001 Shideler
6,497,001 B2 12/2002 Di Nunzio et al.
6,598,262 B2 7/2003 Farina
6,695,235 B2 2/2004 Faller et al.
6,752,433 B2 6/2004 Frost
6,776,363 B1 8/2004 Falletta et al.
6,866,486 B2 3/2005 Dexter et al.
6,892,957 B2 * 5/2005 Bennett et al. ..... 239/146
6,929,198 B2 8/2005 Dexter
6,945,261 B2 9/2005 Wadsworth et al.
7,121,484 B2 10/2006 Daley
RE39,422 E 12/2006 Clemons
7,172,658 B2 2/2007 Field et al.
7,198,204 B2 4/2007 Bennett et al.
7,217,053 B2 5/2007 Alexander et al.
7,308,900 B2 12/2007 Otterson
7,314,186 B1 1/2008 Aesch, Jr.
7,367,082 B2 5/2008 Gordon et al.
7,891,036 B2 * 2/2011 Hahn et al. ..... 15/50.3
2003/0062430 A1 4/2003 Cook
2003/0129065 A1 7/2003 Hu
2005/0145270 A1 * 7/2005 Ray ..... 134/174
2005/0189437 A1 9/2005 Alexander et al.
2005/0194024 A1 * 9/2005 Wadsworth et al. ..... 134/26
2006/0102212 A1 5/2006 Leasure et al.
2006/0102745 A1 5/2006 Dexter
2006/0108449 A1 5/2006 Sodemann et al.
2006/0130884 A1 6/2006 Liao
2006/0156497 A1 7/2006 Burkholder et al.
2006/0254008 A1 11/2006 Hahn et al.
2006/0275146 A1 12/2006 Williams
2007/0169796 A1 7/2007 Johnson et al.

* cited by examiner

SURFACE CLEANER SYSTEM

CROSS-REFERENCE TO RELATED APPLICATIONS

This application claims priority to U.S. Provisional Patent Application No. 61/047,655, filed Apr. 24, 2008, the entire contents of which are hereby incorporated by reference. This application is also a continuation-in-part of U.S. patent application Ser. No. 11/376,610, filed Mar. 14, 2006, which claims priority to U.S. Provisional Patent Application No. 60/664,665, filed Mar. 18, 2005, the entire contents of both of which are hereby incorporated by reference.

BACKGROUND

The present invention relates to surface cleaner systems.

Surface cleaners are often used to provide a continuous flow of relatively high pressure water onto a large, substantially flat surface. Conventional surface cleaners include one or more nozzles to direct high pressure fluid onto surfaces that are disposed directly below the cleaners. Typically, such a surface cleaner is fluidly connected to an independent pressure washer or other source of high pressure fluid through a hose. In such arrangements, both the pressure washer and the surface cleaner must often be repeatedly and independently moved by an operator when cleaning a large surface.

SUMMARY

In one embodiment, the invention provides a surface cleaner system including a base assembly having a housing movable along a surface, a pump supported by the housing and operable to pressurize a fluid, and a prime mover supported by the housing. The prime mover is coupled to the pump to drive the pump. The surface cleaner system also includes a spray assembly coupled to the housing. The spray assembly is operable to discharge fluid from the pump toward the surface. The surface cleaner system further includes a spray gun in fluid communication with the pump to receive pressurized fluid from the pump. The spray gun includes an outlet portion that is connectable to the base assembly to direct the pressurized fluid from the pump into the spray assembly. When the outlet portion is disconnected from the base assembly, the spray gun discharges the pressurized fluid from the pump toward the surface without directing the pressurized fluid into the spray assembly.

In another embodiment, the invention provides a surface cleaner system including a pump operable to pressurize a fluid and a housing having a skirt that defines an opening. The housing is movable along a surface. The surface cleaner system also includes at least one wheel coupled to the housing to facilitate movement of the housing along the surface and a spray assembly rotatably coupled to the housing substantially within the opening. The spray assembly includes a hub coupled to the housing and defining an axis. The hub is operable to rotate about the axis. The spray assembly also includes an elongated tube coupled to and extending radially from the hub. The elongated tube is operable to receive pressurized fluid from the pump. The spray assembly further includes a nozzle coupled to the elongated tube. The nozzle is operable to discharge the pressurized fluid from the elongated tube toward the surface. The surface cleaner system further includes a spray gun in fluid communication with the pump to receive pressurized fluid from the pump. The spray gun includes an outlet portion that is connectable to the housing to direct the pressurized fluid from the pump into the elongated tube of the spray assembly. When the outlet portion is disconnected from the housing, the spray gun discharges the pressurized fluid toward the surface without directing the pressurized fluid into the spray assembly.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting.

Figure 7:
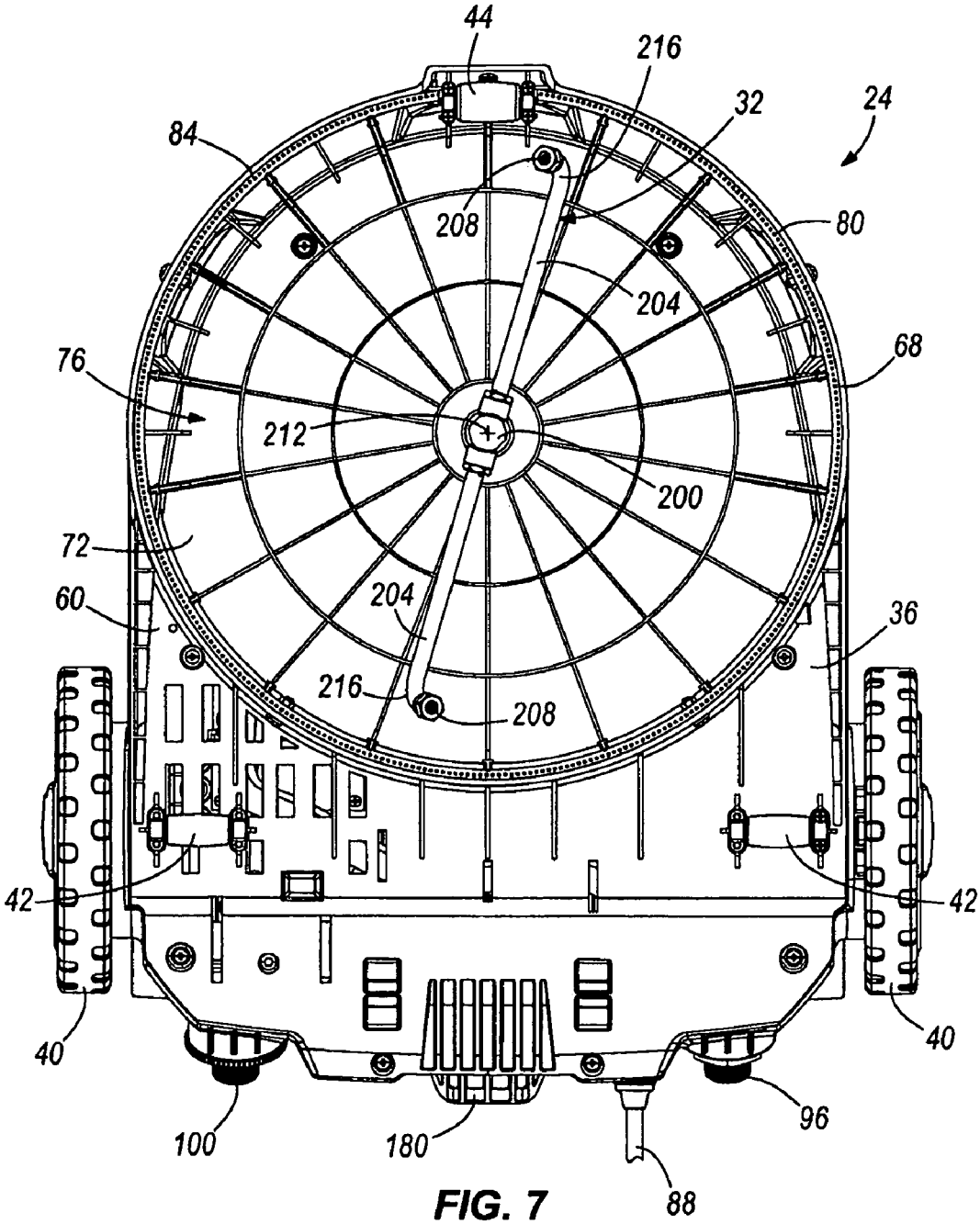
FIG. 7 is a bottom view of the surface cleaner system shown in FIG. 1.

FIGS. 1-4 illustrate a surface cleaner system 20 embodying the invention. The illustrated surface cleaner system 20 includes a base assembly 24, a spray gun 28, and a spray assembly 32 (FIG. 7). The base assembly 24 is movable over a ground surface (e.g., a floor, a deck, a porch, a driveway, etc.) to spray water and/or other fluid from the spray assembly 32 onto the surface and thereby clean the surface. As discussed further below, the spray gun 28 is connected to the base assembly 24 in a first mode (FIGS. 1-3) to function as a handle for the surface cleaner system 20 and is disconnected from the base assembly 24 in a second mode (FIG. 4) to function as a conventional spray gun.

Figure 5:
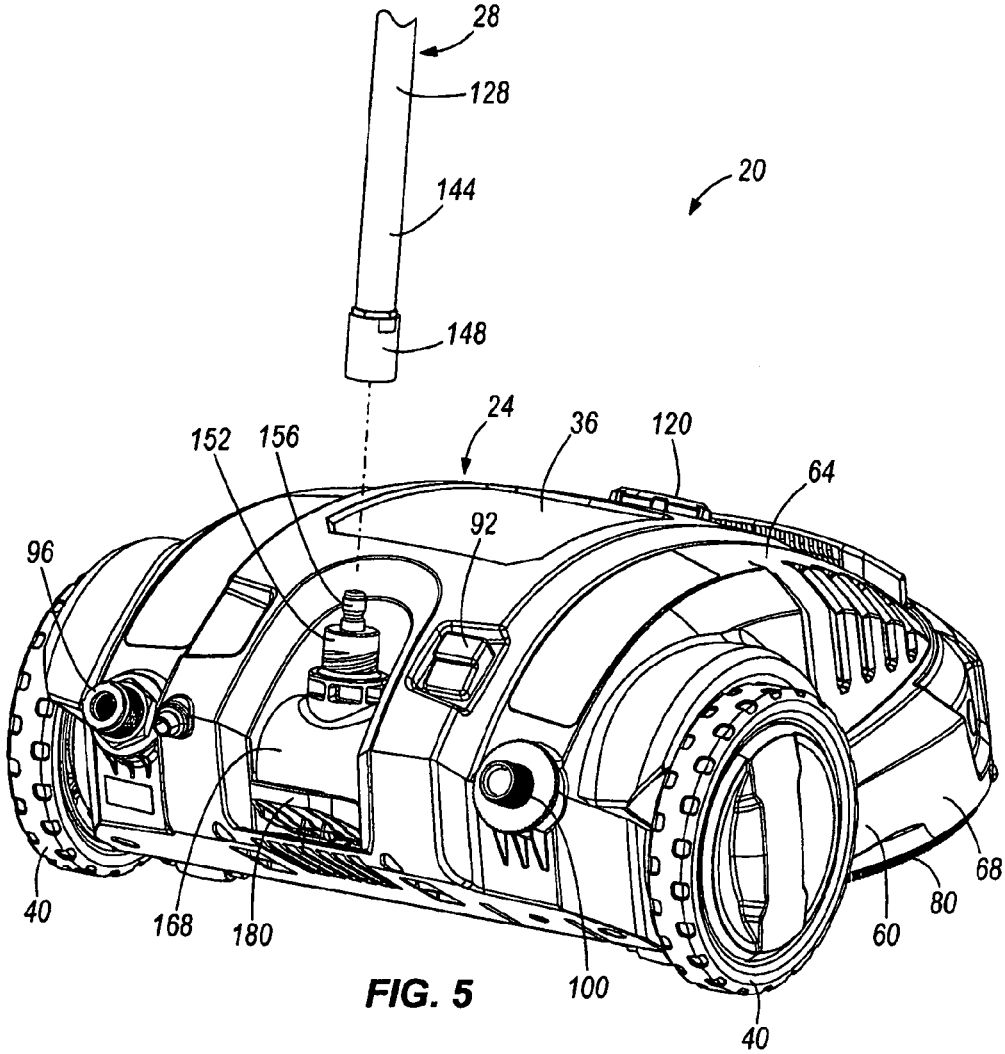
FIG. 5 is a rear perspective view of the surface cleaner system shown in FIG. 1 with the spray gun disconnected from the base assembly.
Figure 6:
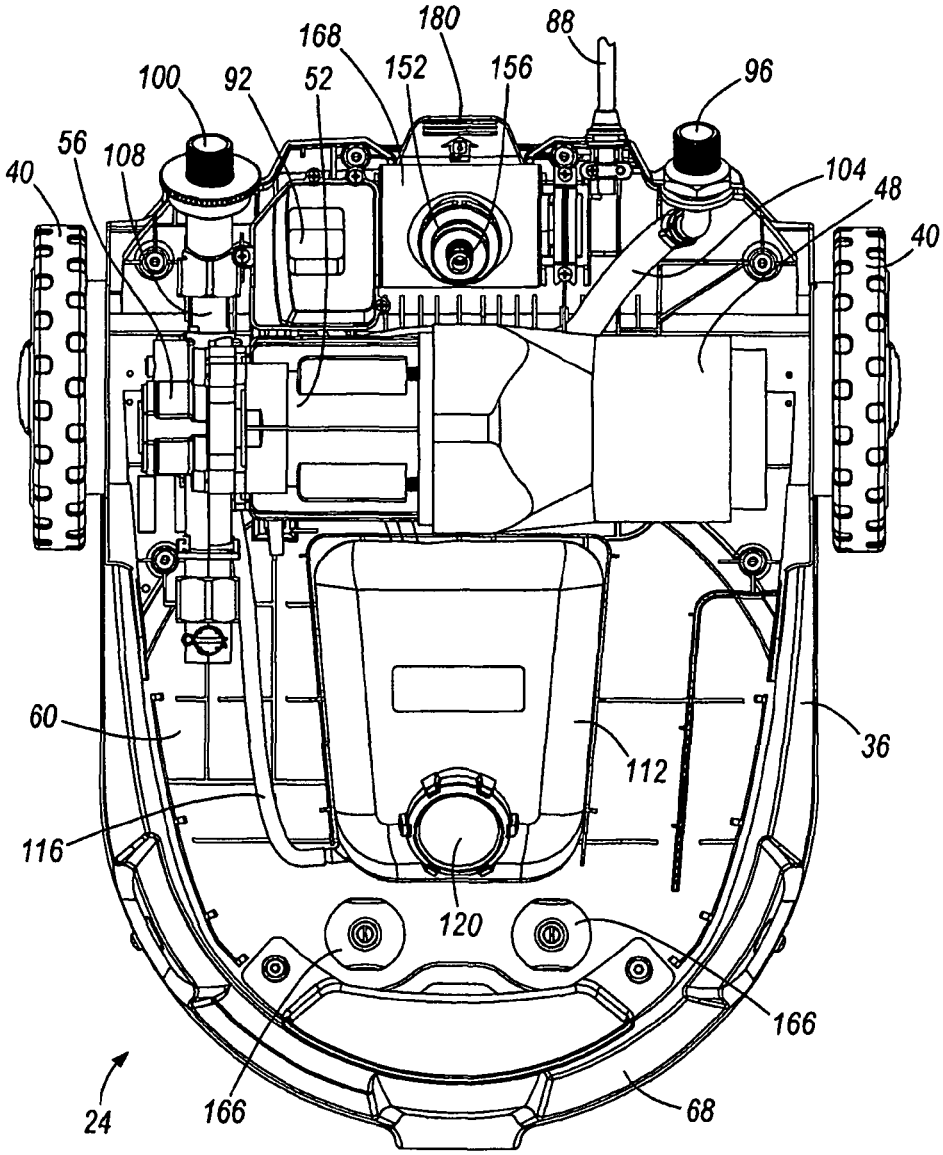
FIG. 6 is a top view of the surface cleaner system shown in FIG. 1 with an upper housing portion of the base assembly removed.

As shown in FIGS. 5 and 6, the base assembly 24, or cleaning deck, includes a housing 36, a plurality of wheels 40, 42, 44 coupled to the housing 36, a motor 48 positioned substantially within the housing 36, a drive mechanism 52 positioned substantially within the housing 36 and coupled to the motor 48, and a pump 56 positioned substantially within the housing 36 and coupled to the drive mechanism 52. In other embodiments, the motor 48 and the pump 56 may be located remotely from the base assembly 24. In the illustrated embodiment, the housing 36 includes a lower housing portion 60 and an upper housing portion 64. The lower housing portion 60 supports the motor 48, the drive mechanism 52, the pump 56, and the other components of the base assembly 24. The upper housing portion 64 is coupled (e.g., bolted, glued, snap-fit, etc.) to the lower housing portion 60 and extends over the components of the base assembly 24 to substantially cover and enclose the components.

As shown in FIGS. 2-4 and 7, the lower housing portion 60 includes a skirt 68 extending from a lower surface 72 of the housing 36 toward the ground surface. The skirt 68 defines a generally circular opening 76 (FIG. 7) and helps inhibit fluid being discharged from the spray assembly 32 from spraying beyond a periphery of the base assembly 24. A plurality of brush-like bristles 80 is coupled to a lower edge 84 of the skirt 68 around the perimeter of the opening 76. The bristles 80 provide contact points to gently scrub the surface during cleaning and further help maintain fluid being discharged from the spray assembly 32 within the periphery of the base assembly 24.

The wheels 40, 42, 44 are coupled to the lower housing portion 60 to facilitate moving the base assembly 24 along the ground surface. In the illustrated embodiment, the base assembly 24 includes two relatively larger wheels 40 mounted to a rear of the housing 36, two relatively smaller wheels 42 (FIG. 7) mounted adjacent to and inward of the larger wheels 40, and a relatively smaller wheel 44 (FIG. 7) mounted to a front of the housing 36. In other embodiments, the base assembly 24 may include fewer or more wheels 40, 42, 44. The smaller rear wheels 42 are positioned inwardly of the periphery of the base assembly 24 to support the base assembly 24 if the larger rear wheels 40 lose contact with the ground surface. For example, when cleaning a curb, step, or other structure that has a drop-off, the surface cleaner system 20 may be positioned such that at least one of the larger wheels 40 extends beyond the edge of the curb/step to ensure the spray assembly 32 completely cleans the curb/step. In such a position, the smaller rear wheels 42 contact the curb/step to support the system 20 and facilitate movement of the base assembly 32 along the curb/step. The illustrated wheels 40, 42, 44 are idle wheels that are independently coupled to the lower housing portion 60. In other embodiments, the wheels 40, 42, 44 may be coupled to a common axle, may be casters to increase the maneuverability of the base assembly 24, and/or may be driven wheels.

Figure 2:
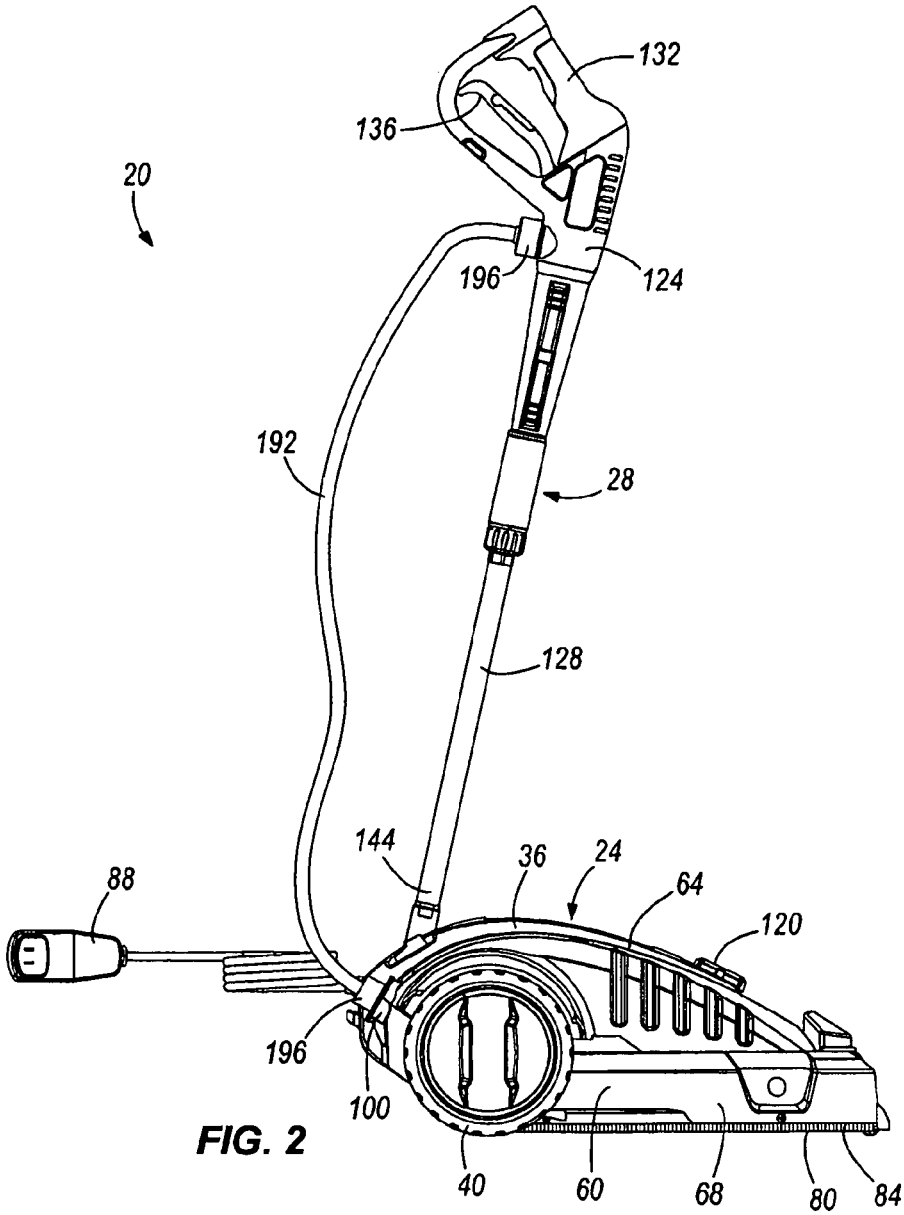
FIG. 2 is a side view of the surface cleaner system shown in FIG. 1 with the spray gun in a storage position.
Figure 3:
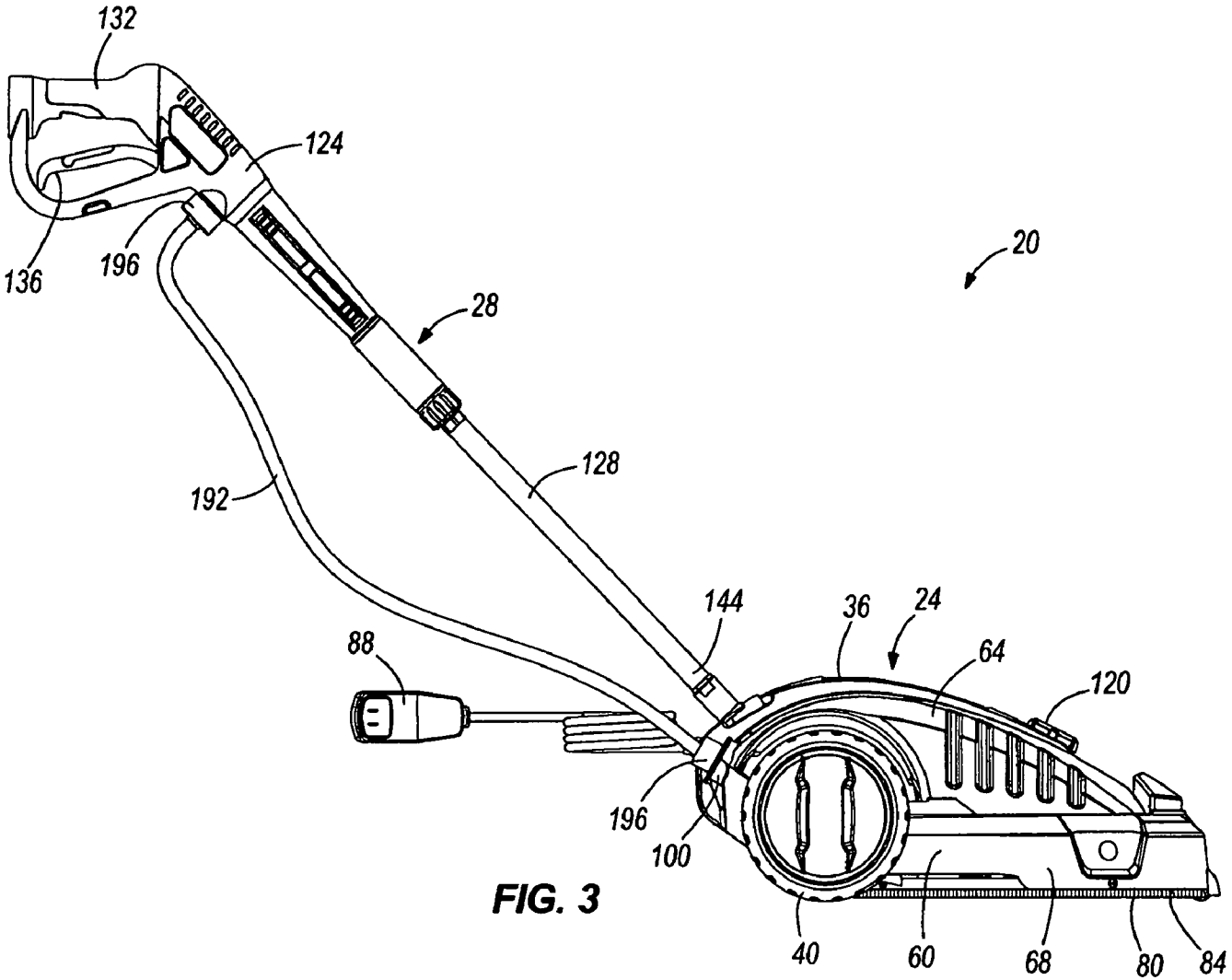
FIG. 3 is a side view of the surface cleaner system shown in FIG. 1 with the spray gun in an operative position.
Figure 4:
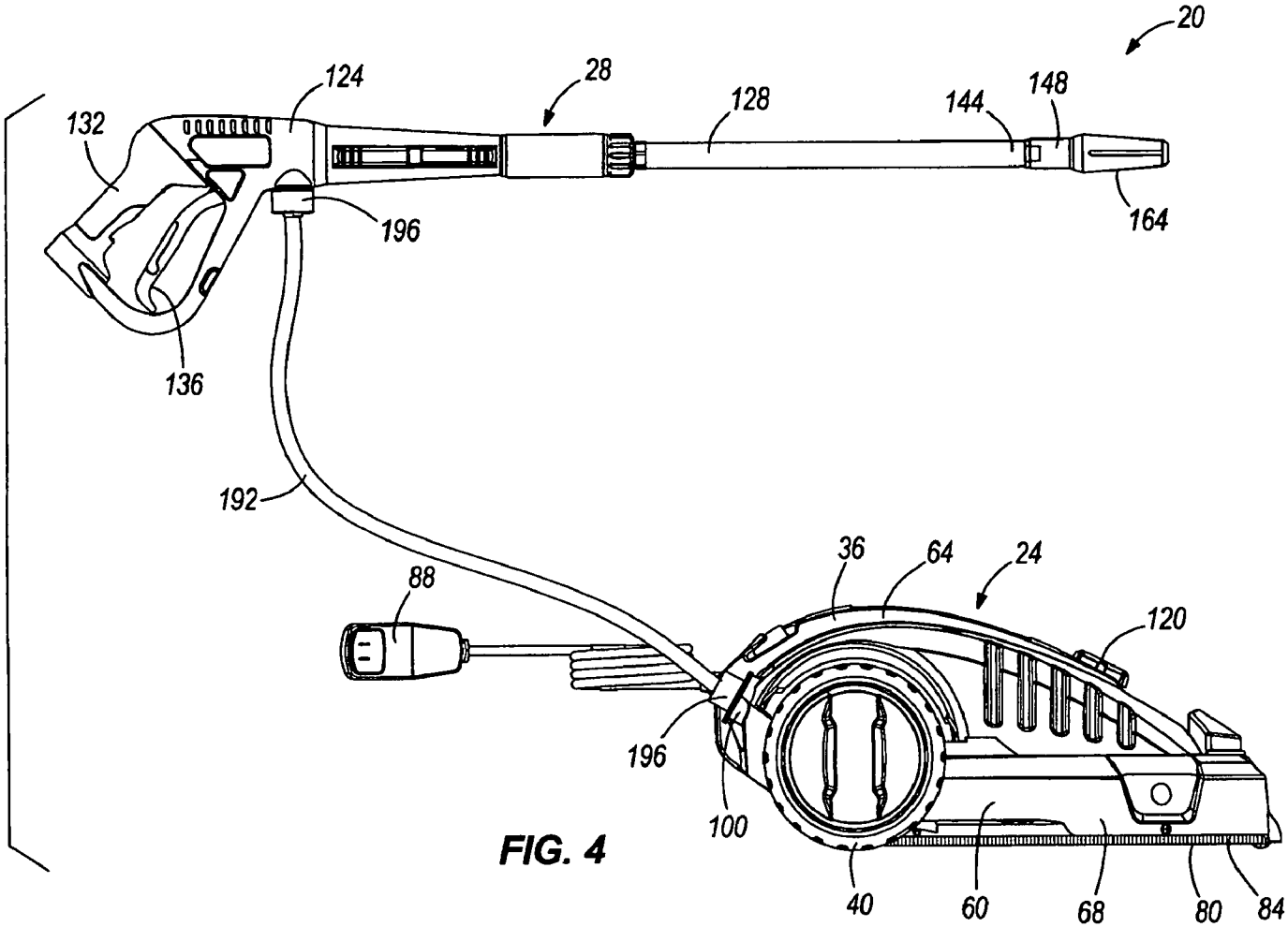
FIG. 4 is a side view of the surface cleaner system shown in FIG. 1 with the spray gun disconnected from the base assembly.

As shown in FIG. 6, the motor 48, or prime mover, is positioned within the housing 36 and includes an output shaft mechanically coupled to the drive mechanism 52. The output shaft drives the drive mechanism 52 which, in turn, drives the pump 56. The illustrated motor 48 is an electric motor that is powered by an external AC power source through a power cord 88 (FIGS. 2-4). In other embodiments, the electric motor 48 may be powered by a DC power source such as, for example, a rechargeable battery supported on the base assembly 24. A power switch 92 is mounted to the base assembly 24 and electrically coupled to the motor 48 to turn the motor 48 on and off. In some embodiments, the motor 48 may be replaced with a different type of prime mover. For example, the base assembly 24 may include an engine that uses gasoline or diesel fuel to drive the pump 56 and power the components of the surface cleaner system 20.

The pump 56 is positioned within the housing 36 and mechanically coupled to the drive mechanism 52 such that the motor 48 drives the pump 56. In the illustrated embodiment, the pump 56 is a positive displacement fluid pump such as, for example, a reciprocating pump, a diaphragm pump, a peristaltic pump, or the like. In other embodiments, other suitable fluid pumps may also or alternatively be employed. Referring to FIGS. 5 and 6, the pump 56 receives fluid at a relatively low pressure from a remote source (e.g., a municipal or local water source) through an inlet connector 96 mounted to the base assembly 24 and outputs fluid at a relatively high pressure through an outlet connector 100 mounted to the base assembly 24. The inlet connector 96 is in communication with the pump 56 through an input line 104, or conduit, and the outlet connector 100 is in communication with the pump 56 through an output line 108, or conduit. In the illustrated embodiment, the connectors 96, 100 are threaded connectors for detachably coupling to, for example, flexible hoses (e.g., a garden hose, a high pressure hose, etc.). In other embodiments, other suitable connectors may also or alternatively be employed.

In some embodiments, the pump 56 is capable of outputting fluid at a rate between about 0.5 and about 5 gallons per minute (gpm). In the illustrated embodiment, the pump 56 outputs fluid at a rate between about 0.75 and about 2.5 gpm and, more particularly, between about 1.0 and about 1.6 gpm. The pump 56 is also capable of outputting fluid at a pressure between about 300 and about 2000 pounds per square inch (psi). In the illustrated embodiment, the pump 56 outputs fluid at a pressure between about 700 and about 1600 psi and, more particularly, between about 1300 and about 1600 psi. The actual flow rate and output pressure of the pump 56 are affected and adjusted by altering geometrical and/or hydrodynamic features of the fluid lines 104, 108 or conduits within the surface cleaner system 20, such as, for example, the inlet flow rate and pressure from the remote fluid source, the diameter of the fluid lines 104, 108, or the like.

In the illustrated embodiment, the motor 48, the drive mechanism 52, and the pump 56 are positioned above the rear wheels 40 and at a higher elevation than the spray assembly 32. Positioning the motor 48 and the pump 56 directly above the rear wheels 40 imparts the weight of the motor 48 and the pump 56 onto the wheels 40 to increase stability and handling of the surface cleaner system 20. In addition, the motor 48 is orientated such that the output shaft is generally parallel to the ground surface to maintain a low profile of the base assembly 24.

As shown in FIG. 6, the base assembly 24 also includes a liquid storage container 112, or tank, mounted to and supported by the lower housing portion 60. The container 112 is configured to retain, for example, a supply of cleaning solution (e.g., soap, disinfectant, etc.) that is selectively mixed with fluid being discharged through the outlet connector 100. A cleaning solution supply line 116, or conduit, extends between the container 112 and the output line 108 to direct the cleaning solution from the container 112 to the output line 108. In some embodiments, a metering valve may be positioned within the supply line 116 or the container 112 to selectively restrict the flow of cleaning solution from the container 112 to the output line 108. The metering valve may be actuated by a dial or lever to adjust the ratio of cleaning solution to fluid (e.g., water) or to completely inhibit cleaning solution from leaving the container 112. Additionally or alternatively, a venturi may be positioned within the cleaning solution supply line 116 to allow fluid flow from the container 112 to the output line 108 when the differential pressure exceeds a predetermined threshold. The illustrated container 112 includes a cap 120 extending through the upper housing portion 64 to facilitate refilling the container 112. In some embodiments, the cap 120 may include an indicator to notify an operator of the fluid level within the container 112. In other embodiments, the indicator may be located elsewhere on the base assembly 24.

As shown in FIGS. 1-4, the spray gun 28 includes a handle portion 124 and a rigid wand 128 or lance coupled to the handle portion 124. The handle portion 124 includes a hand grip 132, a trigger 136, and an inlet connector 140 to fluidly couple the spray gun 28 to the pump 56. The hand grip 132 is shaped and sized to be comfortably gripped by a user during operation of the surface cleaner system 20. The trigger 136 is coupled to an isolation valve within the spray gun 28 to selectively allow pressurized fluid from the pump 56 to flow through the wand 128. The illustrated trigger 136 is mechanically coupled to the isolation valve via a linkage or lever such that actuation of the trigger 136 causes the valve to open. The trigger 136 and the isolation valve are normally biased toward a closed, or shut, position to block fluid from flowing through the wand 128. Actuating (e.g., depressing) the trigger 136 against the biasing force opens the valve by varying degrees to adjust the amount of fluid flow through the spray gun 28.

Figure 1:
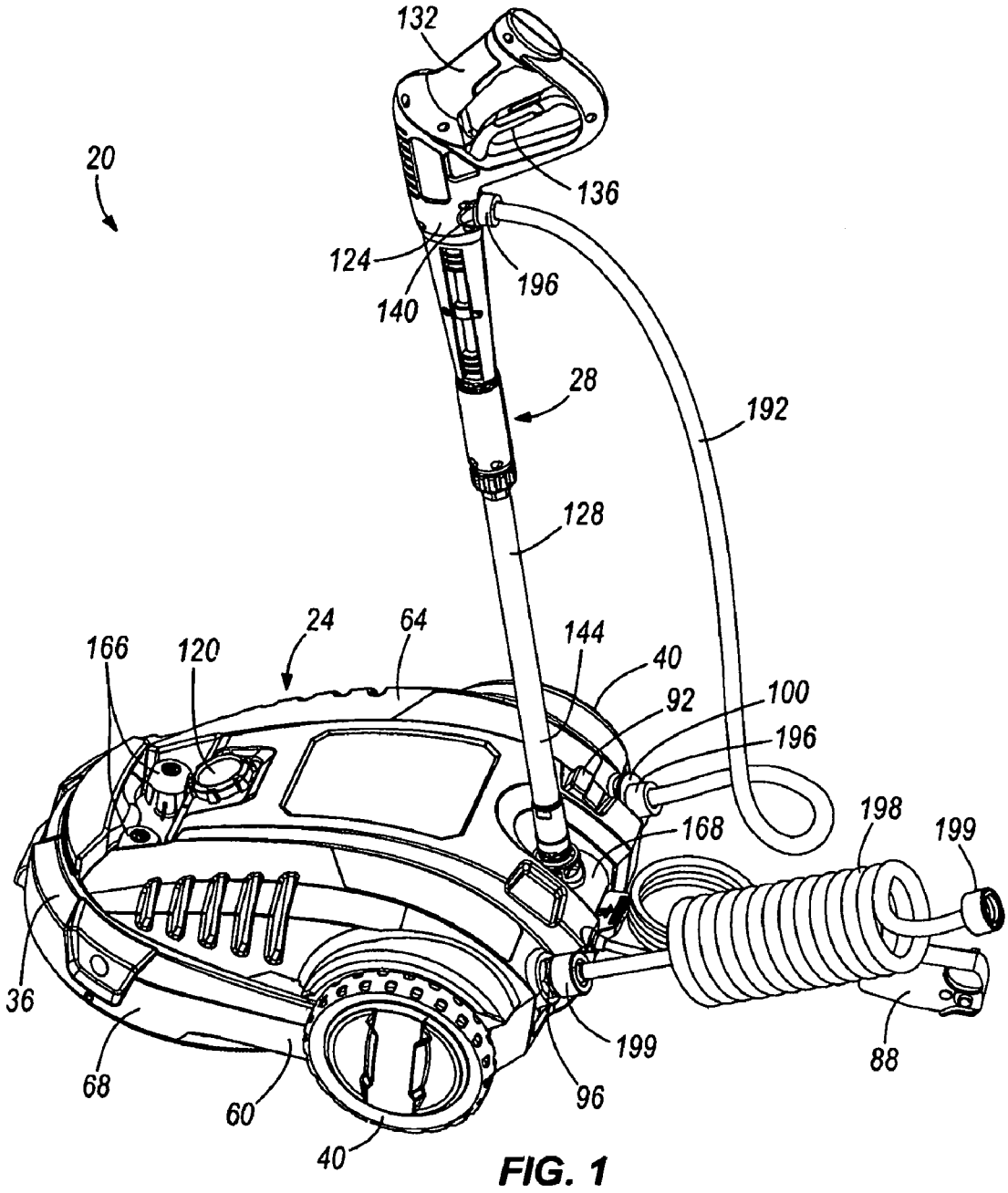
FIG. 1 is a top perspective view of a surface cleaner system embodying the invention, the surface cleaner system including a base assembly and a spray gun.
Figure 8A:
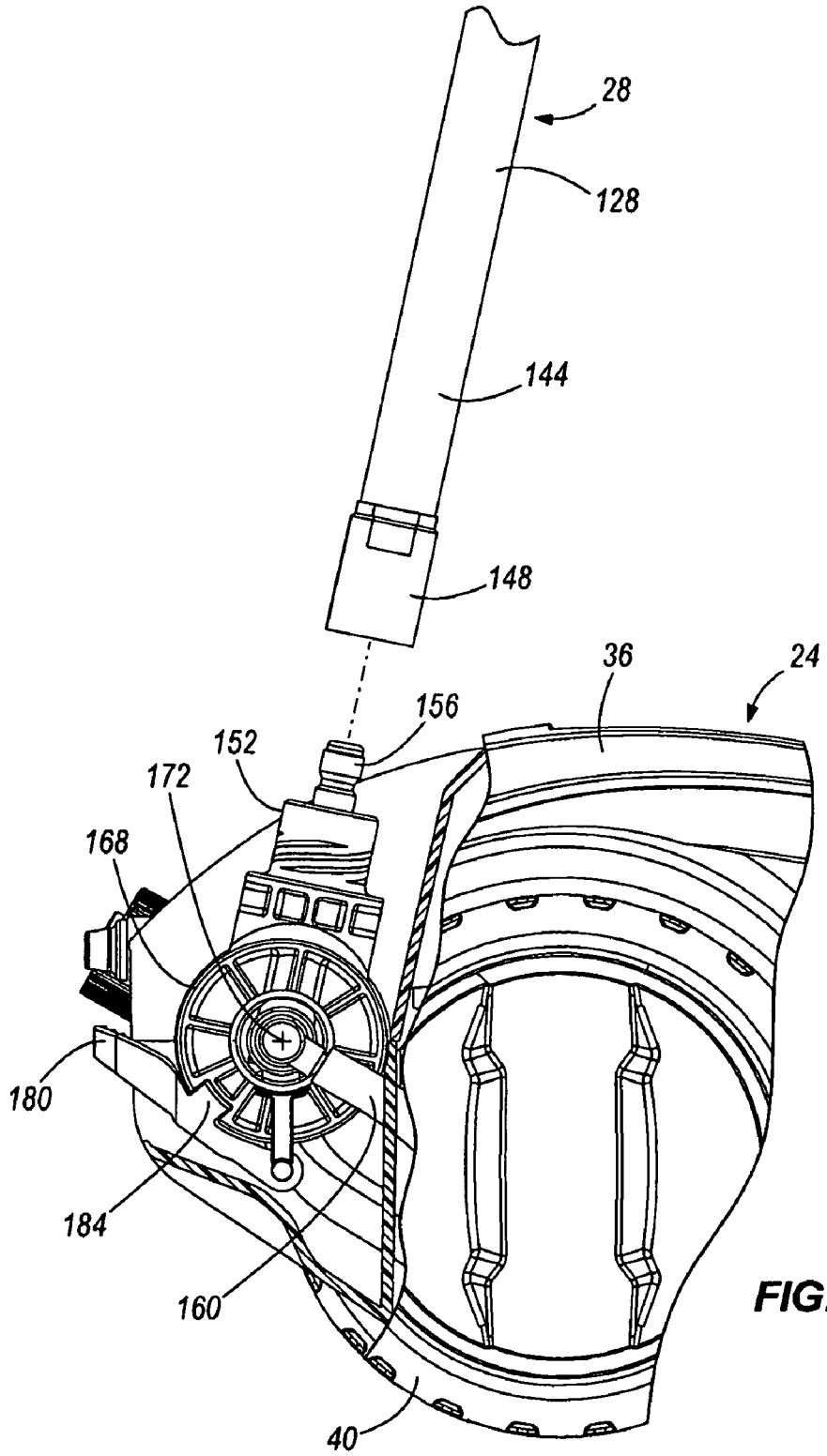
FIG. 8A is a partial cross-sectional view of a portion of the surface cleaner system shown in FIG. 1 with the spray gun disconnected from the base assembly.

The wand 128 extends from the handle portion 124 and defines a conduit for fluid flow. In the illustrated embodiment, the wand 128 is removably coupled to the handle portion 124 to extend the length of the spray gun 28. In other embodiments, the wand 128 may be integrally formed as a single piece with the handle portion 124. The wand 128 includes an outlet portion 144 for discharging the fluid from the spray gun 28. The outlet portion 144 includes a quick-connect coupling 148 for engaging an inlet coupling 152 (FIGS. 5, 6, and 8A) on the base assembly 24 when the surface cleaner system 20 is in the first mode (FIGS. 1-3). As shown in FIG. 8A, the illustrated quick-connect coupling 148 receives a portion 156 of the inlet coupling 152 to securely mount the spray gun 28 to the base assembly 24 without the use of tools. In some embodiments, the quick-connect coupling 148 and the inlet coupling 152 may include corresponding flats, keying features, splines, or other non-circular elements to inhibit the spray gun 28 from rotating when connected to the base assembly 24. The inlet coupling 152 is in communication with the spray assembly 32 via a spray line 160, or conduit, to direct pressurized fluid from the spray gun 28 to the spray assembly 32.

Figure 8B:
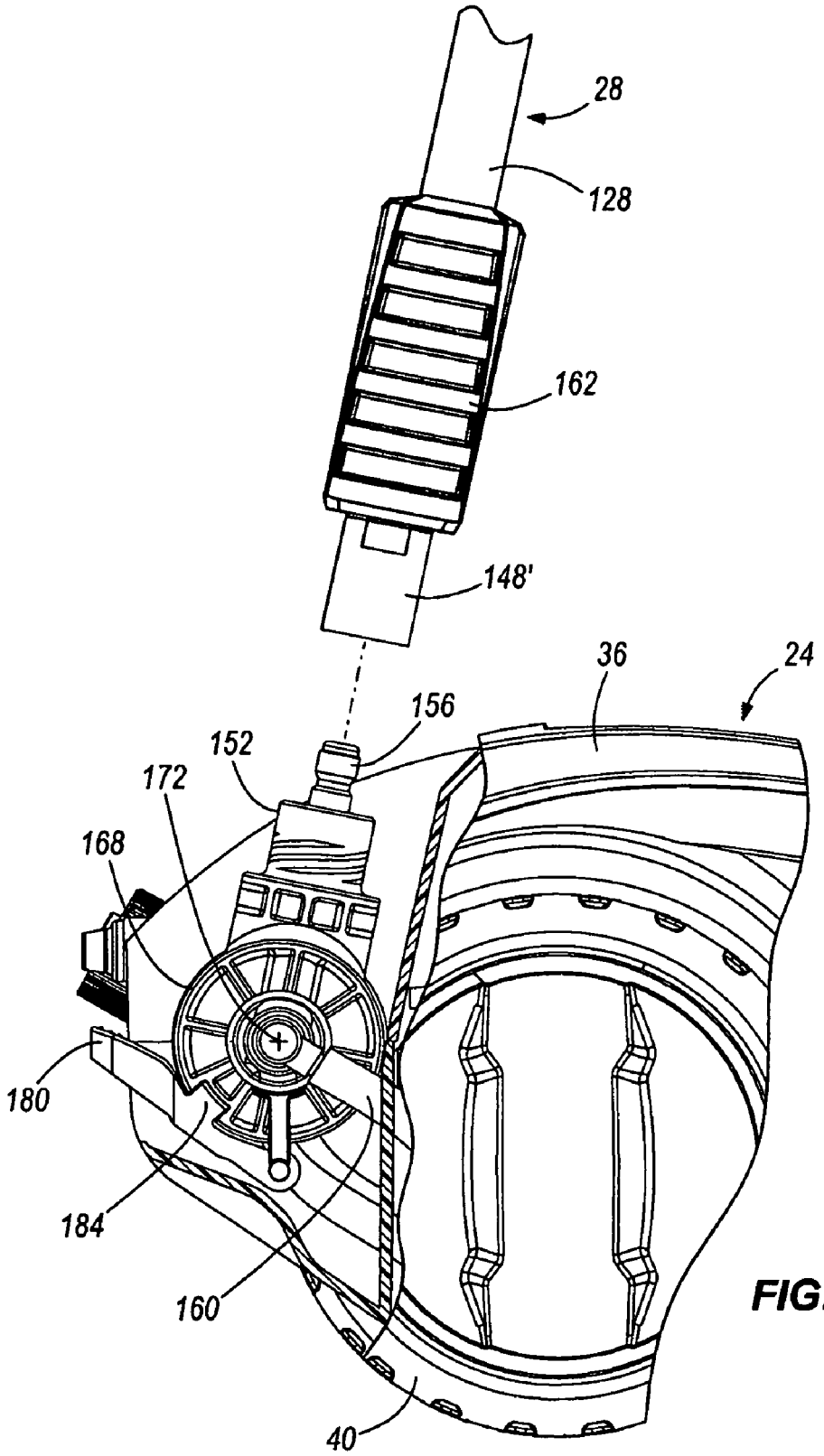
FIG. 8B is a partial cross-sectional view of a portion of the surface cleaner system illustrating another embodiment of a coupling between the spray gun and the base assembly.

FIG. 8B illustrates the surface cleaner system 20 including another embodiment of a quick-connect coupling 148'. The illustrated quick-connect coupling 148' includes a collar 162, or sleeve, that is axially movable along the outlet portion 144 of the wand 128. The collar 162 is rotatable relative to the wand 128 to threadably engage the inlet coupling 152 and thereby secure the spray gun 28 to the base assembly 24. In other embodiments, other suitable quick-connect couplings may alternatively be employed.

Referring back to FIG. 8A, when the surface cleaner system 20 is in the second mode (FIG. 4), the quick-connect coupling 148 is disconnected from the inlet coupling 152, and a nozzle 164, 166 is coupled to the quick-connect coupling 148. The nozzle 164, 166 discharges fluid from the spray gun 28 directly onto a surface in the surrounding environment without first directing the fluid through the spray assembly 32. In the illustrated embodiment, a plurality of nozzles with different spray patterns may be interchangeably coupled to the spray gun 28. For example, as shown in FIG. 4, a rotary nozzle 164 may be removably coupled to the spray gun 28 via the quick-connect coupling 148. Additionally, as shown in FIGS. 1 and 6, two alternative nozzles 166 are mounted to the housing 36 and may be interchangeably coupled to the spray gun 28.

Figure 9:
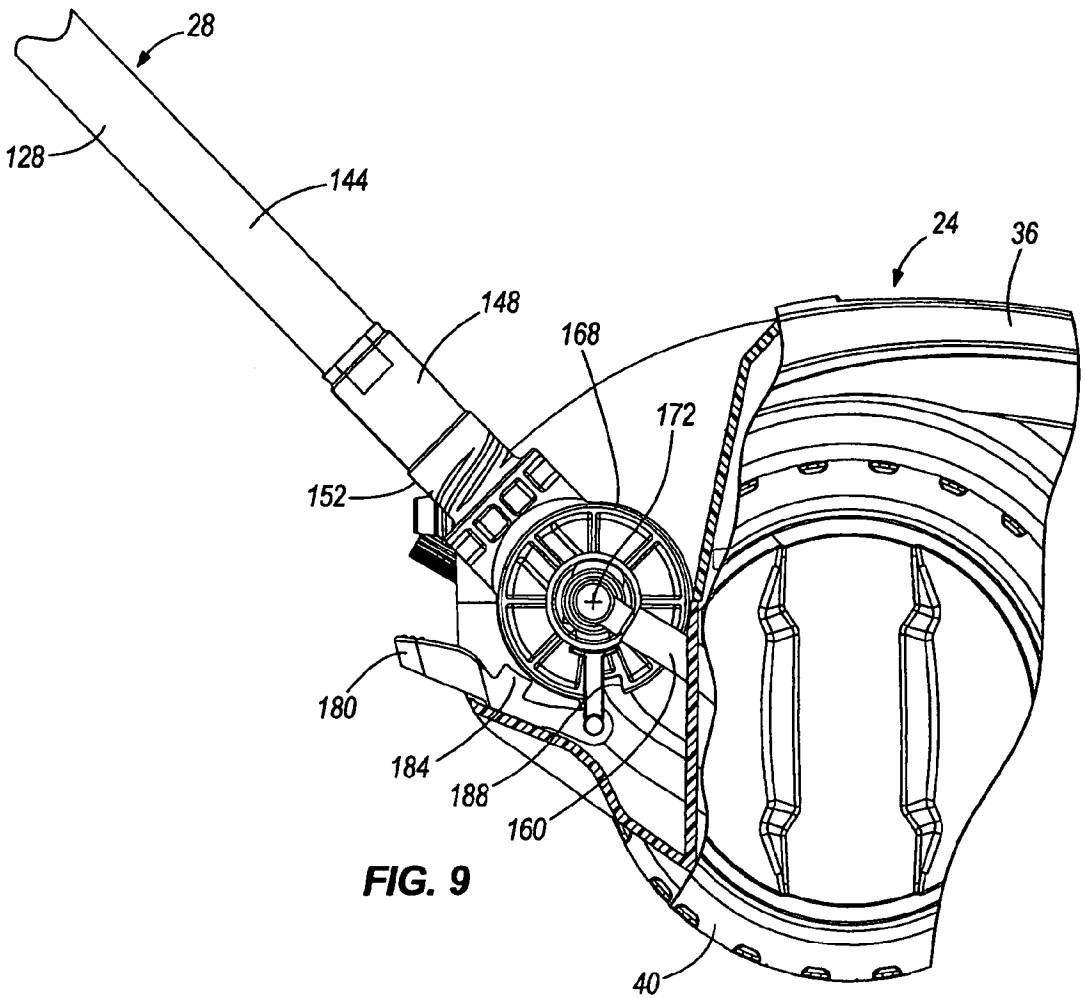
FIG. 9 is a partial cross-sectional view of the portion of the surface cleaner system shown in FIG. 8A with the spray gun in the operative position.

As shown in FIGS. 8A and 9, the inlet coupling 152 is supported by a cylinder 168 to pivotally couple the spray gun 28 to the base assembly 24. The cylinder 168 is rotatably coupled to the housing 36 of the base assembly 24 about a pivot axis 172 such that the cylinder 168 may rotate relative to the housing 36. The inlet coupling 152 extends radially from the cylinder 168 and is in communication with the spray line 160 through a passageway formed in the cylinder 168. The cylinder 168 includes high pressure water seals suitable to prevent leakage between the passageway and the spray line 160. When the spray gun 28 is connected to the inlet coupling 152, the cylinder 168 may rotate about the pivot axis 172 to adjust the orientation of the spray gun 28 relative to the base assembly 24. In the illustrated embodiment, the spray gun 28 is pivotable from a storage position (FIGS. 1 and 2), in which the spray gun 28 is generally upright, to an operative position (FIGS. 3 and 9), in which the spray gun 28 extends rearwardly from the base assembly 24 to facilitate pushing or pulling the base assembly 24 along the ground surface.

In the illustrated embodiment, a pedal 180 is coupled to the housing 36 adjacent to the cylinder 168 to releasably secure the spray gun 28 in the storage position. The illustrated pedal 180 includes a rib 184 extending toward the cylinder 168, and the cylinder 168 defines a recess 188 (FIG. 9) configured to receive the rib 184. In the storage position (FIG. 8A), the rib 184 is biased into the recess 188 to inhibit rotation of the cylinder 168 about the pivot axis 172. Actuating (e.g., depressing) the pedal 180 moves the rib 184 out of the recess 188, allowing the cylinder 168 to freely rotate about the pivot axis 172. The spray gun 28 may then be pivoted by a user to an operative position within a continuous range of positions. In some embodiments, the cylinder 168 may define a plurality of recesses to releasably secure the spray gun 28 in a discrete number of operative positions. In other embodiments, other suitable locking mechanisms may alternatively be employed to secure the spray gun 28 in the storage position and/or the operative position.

As shown in FIGS. 1-4, a high pressure flexible hose 192 extends between the outlet connector 100 on the base assembly 24 and the inlet connector 140 on the spray gun 28 to fluidly couple the pump 56 to the spray gun 28. The illustrated hose 192 is formed from a plurality of layers to provide adequate strength and flexibility for high pressure applications. In some embodiments, the hose 192 may include an internal layer of rubber, a polymer, or the like that defines a conduit for fluid flow. The internal layer may be surrounded by a network of woven or braided fibers to provide adequate hoop strength for the hose 192. This woven layer may be formed of, for example, high strength polyester fibers, steel fibers, or the like. The hose 192 may also include an outer layer disposed around the woven layer to provide a relatively smooth outer coating. The outer layer may be composed of polyvinyl chloride (PVC), polyurethane, santoprene, or another suitable material.

In the illustrated embodiment, the hose 192 is removably connected to the outlet connector 100 of the base assembly 24 and the inlet connector 140 of the spray gun 28 with threaded connectors 196. In other embodiments, the hose 192 may be permanently connected to one or both of the outlet and inlet connectors 100, 140. In still other embodiments, the hose 192 may be semi-permanently connected to the outlet and inlet connectors 100, 140 with, for example, compression fittings that require external tools to assemble and disassemble the hose 192. In some embodiments, the spray gun 28 may include hooks, straps, or other elements that serve as a hose or cord wrap to retain an excess length of the hose 192 or the power cord 88.

As shown in FIG. 1, a second low pressure hose 198 is connected to the inlet connector 96 on the base assembly 24. The lower pressure hose 198 directs fluid from a remote source into the inlet line 104 and toward the pump 56 (FIG. 5). Similar to the high pressure hose 192, the low pressure hose 198 includes threaded connectors 199 to connect to the inlet connector 96 and, for example, a garden hose. The illustrated low pressure hose 198 is a self-coiling hose configured to relieve tension on the inlet connector 96 when connected to the garden hose. For example, when the garden hose is extended to a maximum length, the low pressure hose 198 may stretch (e.g., uncoil) such that the garden hose does not pull on the inlet connector 96. In addition, the self-coiling feature of the hose 198 inhibits a large length of hose from collecting near the base assembly 24 and interfering with a user walking behind the base assembly 24.

Figure 10:
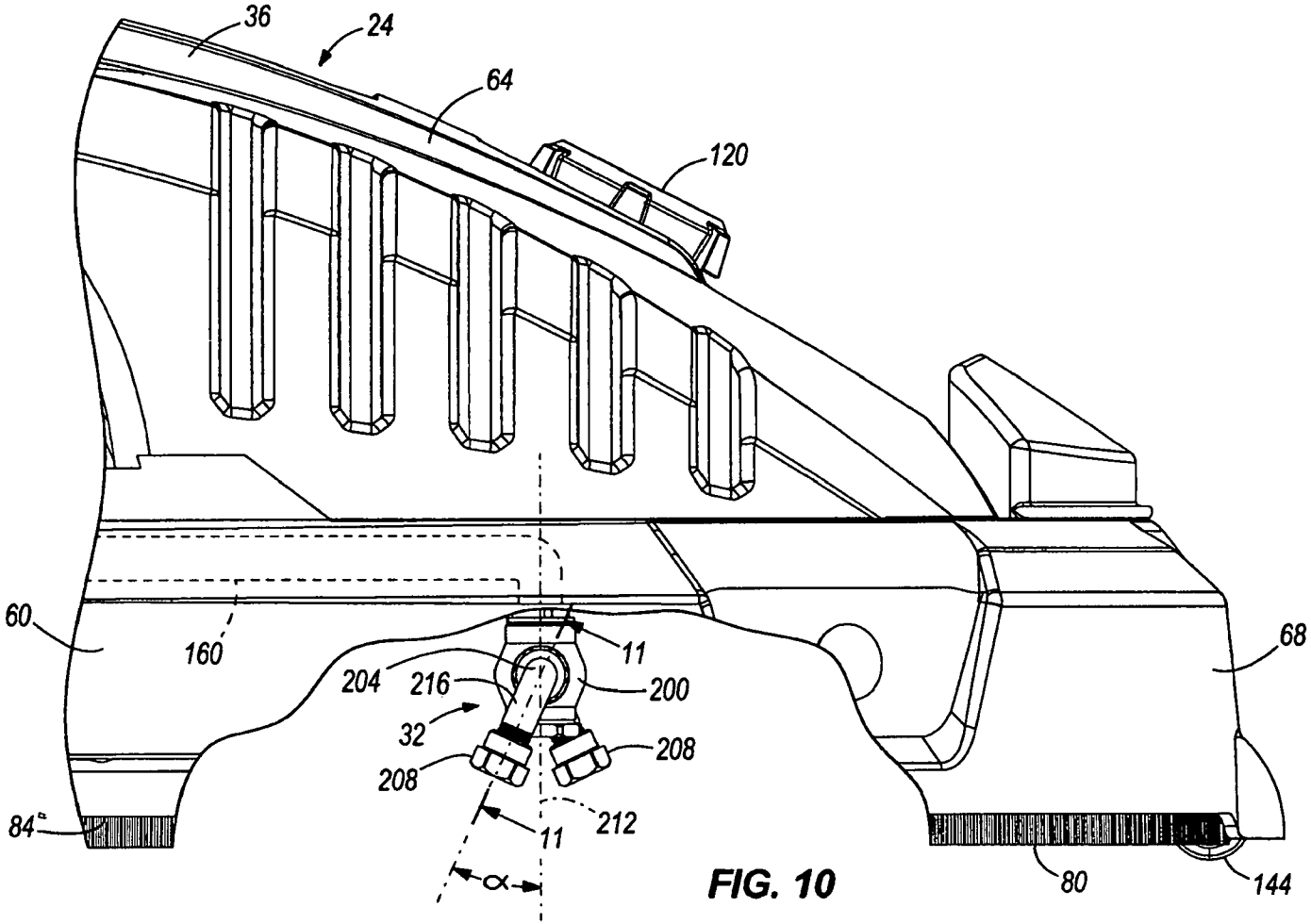
FIG. 10 is an enlarged side view of another portion of the surface cleaner system shown in FIG. 1.

As shown in FIGS. 7 and 10, the spray assembly 32 is coupled to the lower surface 72 of the lower housing portion 60 substantially within the opening 76. In some embodiments, the spray assembly 32 may be a separate unit that is removably coupled to the base assembly 24. In the illustrated embodiment, the spray assembly 32 includes a hub 200 rotatably coupled to the lower housing portion 60, a pair of elongated tubes 204 extending from the hub 200, and a nozzle 208 coupled to each tube 204. In other embodiments, other suitable spray assemblies may be coupled to the base assembly 24. The hub 200 is in fluid communication with the spray line 160 and defines an axis 212 that the spray assembly 32 rotates about. The illustrated axis 212 extends longitudinally through the hub 200 and generally perpendicularly through the lower surface 72 of the housing 36. The elongated tubes 204 are generally hollow and extend radially from the hub 200 to direct the pressurized fluid from the spray line 160 to the nozzles 208. In the illustrated embodiment, the spray assembly 32 includes two tubes 204 extending in opposite directions from the hub 200. In other embodiments, the spray assembly 32 may include fewer or more elongated tubes 204 extending from the hub 200.

Each nozzle 208 is coupled to an end portion 216 of the corresponding tube 204 to discharge the pressurized fluid from the tubes 204 toward the ground surface. The illustrated nozzles 208 are staggered to impart a torque on the hub 200 as fluid is discharged from the nozzles 208. The torque rotates the hub 200, and thereby the elongated tubes 204 and the nozzles 208, about the axis 212 to distribute pressurized fluid evenly over the ground surface. In other embodiments, the hub 200 may be driven by the motor 48 to rotate the spray assembly 32, or the spray assembly 32 may remain generally stationary relative to the base assembly 24 during operation of the surface cleaner system 20. As shown in FIG. 10, the end portion 216 of each elongated tube 204 is bent at approximately 90° relative to the length of the tube 204. In addition, the end portions 216 are turned away from the ground surface such that the nozzles 208 discharge fluid at an acute angle $\alpha$ relative to the axis 212 of rotation. In some embodiments, the angle $\alpha$ is between approximately 5° and approximately 30°. In the illustrated embodiment, the angle $\alpha$ is between approximately 10° and approximately 20°.

Figure 11:
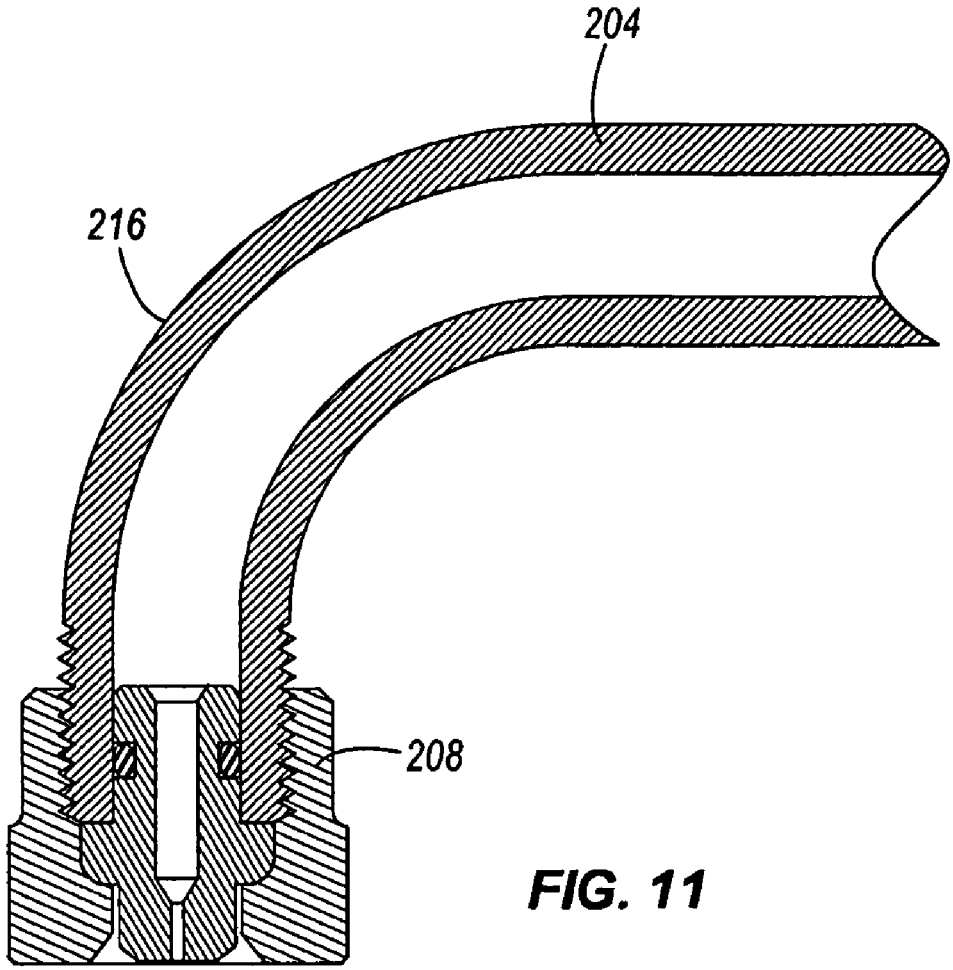
FIG. 11 is a cross-sectional view of a spray assembly of the surface cleaner system taken along section line 11-11 of FIG. 10.

As shown in FIG. 11, the illustrated nozzles 208 are threadably coupled to the tubes 204 to facilitate removing and interchanging the nozzles 208 on the spray assembly 32. In other embodiments, the nozzles 208 may be connected to the tubes 204 using other suitable coupling means, or the nozzles 208 may be permanently attached to or integrally formed with the tubes 204. Additionally or alternatively, in some embodiments, multiple nozzles 208 may be coupled to each tube 204 and/or the nozzles 208 may be located elsewhere on the tubes 204.

The surface cleaner system 20 may additionally include one or more sensors that monitor one or more parameters of the system 20. For example, the system 20 may include a pressure sensor in communication with the output line 108 to monitor the pressure of fluid leaving the pump 56. In some embodiments, the pressure sensor may be configured to measure the rate of change of pressure of fluid leaving the pump 56. The system 20 may also include a flow sensor in communication with the output line 108 to monitor the flow rate, or rate of change of the flow rate, of fluid leaving the pump 56. The sensors may be electrically coupled to a controller which receives signals from the sensors, processes the signals, and directs necessary directions to various components of the surface cleaner system 20. For example, if the pressure sensor outputs a signal indicative of a pressure below a predetermined set point, the controller may allow current to flow to the motor 48 to drive the pump 56 and increase the flow pressure. Alternatively, if the measured pressure is equal to or exceeds the predetermined set point (e.g., when the spray gun 28 and the spray assembly 32 are not discharging fluid), the controller may temporarily interrupt current to the motor 48 such that the pump 56 stops pressurizing fluid.

In operation, the base assembly 24 is connected to a remote fluid source through the inlet connector 96. The power cord 88 is plugged into a wall outlet, and a user actuates the power switch 92 to provide AC power to the motor 48. When powered, the motor 48 drives the drive mechanism 52 and the pump 56. The pump 56 receives fluid (e.g., water) from the remote fluid source at a relatively low pressure and discharges the fluid at a relatively high pressure. If desired, the metering valve in the cleaning solution supply line 116 may be opened to allow cleaning solution to mix with pressurized fluid exiting the pump 56. The pressurized fluid (and cleaning solution) exits the base assembly 24 through the outlet connector 100 and flows toward the spray gun 28 through the flexible hose 192.

As mentioned above, the surface cleaner system 20 is operable in the first mode (FIGS. 1-3), in which the outlet portion 144 of the spray gun 28 is connected to the base assembly 24, and in the second mode (FIG. 4), in which the outlet portion 144 of the spray gun 28 is disconnected from the base assembly 24. When in the first mode, the quick-connect coupling 148 of the spray gun 28 is coupled to the inlet coupling 152 of the base assembly 24 to direct pressurized fluid from the spray gun 28 to the spray assembly 32. Actuating the trigger 136 of the spray gun 28 allows pressurized fluid from the pump 56 to flow through the spray gun 28 and into the spray line 160 in the base assembly 24. The spray line 160 directs the pressurized fluid into the spray assembly 32 to discharge the fluid through the nozzles 208. As the fluid exits the nozzles 208, the spray assembly 32 rotates about the axis 212 such that fluid is sprayed evenly over the ground surface within the periphery of the skirt 68. The trigger 136 may be actuated by varying degrees to adjust the amount of pressurized fluid flowing through the spray gun 28 and into the spray assembly 32.

To move the spray gun 28 from the storage position (FIGS. 1 and 2) to the operative position (FIG. 3), the pedal 180 is actuated by a user to move the rib 184 out of the recess 188 in the cylinder 168. The cylinder 168 may then rotate about the pivot axis 172 to pivot the spray gun 28 relative to the base assembly 24. Pivoting the spray gun 28 to the operative position allows the user to push or pull the base assembly 24 along the ground surface. Actuating the trigger 136 of the spray gun 28 while in the operative position directs pressurized fluid into the spray assembly 32 to discharge fluid onto the ground surface as the base assembly 24 moves along the surface.

When in the second mode, the quick-connect coupling 148 of the spray gun 28 is disconnected and separated from the inlet coupling 152 of the base assembly 24. One of the nozzles 164, 166 is connected to the outlet portion 144 of the spray gun 28 to discharge fluid from the spray gun 28 in a controlled pattern. Actuating the trigger 136 of the spray gun 28 allows pressurized fluid from the pump 56 to flow through the spray gun 28 and be discharged directly onto a surface (e.g., the ground surface, a wall or siding, windows, furniture, steps, etc.). That is, the fluid is discharged from the spray gun 28 onto a surface without first passing through the spray assembly 32. The spray gun 28 may thereby be used as a conventional spray gun to clean surfaces over which it is difficult or impossible to move the base assembly 24.

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. A surface cleaner system comprising:

a base assembly including a housing movable along a surface, a pump supported by the housing and operable to pressurize a fluid, and a prime mover supported by the housing, the prime mover coupled to the pump to drive the pump;

a spray assembly coupled to the housing, the spray assembly operable to discharge fluid from the pump toward the surface; and a spray gun in fluid communication with the pump to receive pressurized fluid from the pump, the spray gun including an outlet portion that selectively connects to the base assembly to direct the pressurized fluid from the pump into the spray assembly, wherein, when the outlet portion is disconnected from the base assembly, the spray gun discharges the pressurized fluid from the pump toward the surface without directing the pressurized fluid into the spray assembly.

2. The surface cleaner system of claim 1, wherein the outlet portion of the spray gun includes a quick-connect coupling and the base assembly includes an inlet coupling in communication with the spray assembly, and wherein the quick-connect coupling engages the inlet coupling to connect the outlet portion to the base assembly and direct the pressurized fluid from the spray gun into the spray assembly.

3. The surface cleaner system of claim 1, wherein, when the outlet portion of the spray gun is connected to the base assembly, the spray gun functions as a handle for the surface cleaner system to move the base assembly along the surface.

4. The surface cleaner system of claim 3, wherein the spray gun includes a handle portion defining a hand grip, wherein the handle portion facilitates moving the base assembly along the surface when the outlet portion is connected to the base assembly, and wherein the handle portion facilitates holding the spray gun when the outlet portion is disconnected from the base assembly.

5. The surface cleaner system of claim 4, wherein the handle portion of the spray gun includes a trigger, and wherein the trigger is actuatable to selectively allow the pressurized fluid to flow through the spray gun toward the outlet portion.

6. The surface cleaner system of claim 1, wherein the base assembly includes an outlet connector and the spray gun includes an inlet connector, wherein the pump discharges pressurized fluid through the outlet connector, and wherein the outlet connector is in fluid communication with the inlet connector to direct the pressurized fluid from the pump toward the spray gun.

7. The surface cleaner system of claim 6, further comprising a hose coupled to the outlet connector of the base assembly and the inlet connector of the spray gun, wherein the hose fluidly couples the pump to the spray gun to direct the pressurized fluid into the spray gun.

8. The surface cleaner system of claim 6, wherein the base assembly includes a second inlet connector, and wherein the second inlet connector is in fluid communication with the pump to direct fluid from a remote fluid source to the pump.

9. The surface cleaner system of claim 8, wherein the second inlet connector of the base assembly receives fluid at a relatively low pressure and the outlet connector of the base assembly discharges the fluid at a relatively high pressure.

10. The surface cleaner system of claim 1, wherein the spray gun is pivotable relative to the base assembly when the outlet portion is connected to the base assembly.

11. The surface cleaner system of claim 1, wherein the base assembly further includes a container supported by the housing, wherein the container is configured to hold a supply of cleaning solution, and wherein the pump is in fluid communication with the container to mix cleaning solution with the pressurized fluid.

12. The surface cleaner system of claim 1, wherein the base assembly further includes a plurality of wheels coupled to the housing to facilitate moving the base assembly along the surface.

13. The surface cleaner system of claim 12, wherein the plurality of wheels includes a first wheel and a second wheel, wherein the first wheel is coupled to the base assembly and extends outwardly beyond a periphery of the base assembly, and wherein the second wheel is coupled to the base assembly adjacent to the first wheel and is positioned inwardly of the periphery of the base assembly.

14. The surface cleaner system of claim 1, wherein at least one of the pump and the prime mover is substantially enclosed within the housing.

15. The surface cleaner system of claim 1, wherein the prime mover is an electric motor.

16. A surface cleaner system comprising:

a pump operable to pressurize a fluid;

a housing including a skirt that defines an opening, the housing movable along a surface;

at least one wheel coupled to the housing to facilitate movement of the housing along the surface;

a spray assembly rotatably coupled to the housing substantially within the opening, the spray assembly including a hub coupled to the housing and defining an axis, the hub operable to rotate about the axis, an elongated tube coupled to and extending radially from the hub, the elongated tube operable to receive pressurized fluid from the pump, and a nozzle coupled to the elongated tube, the nozzle operable to discharge the pressurized fluid from the elongated tube toward the surface; and a spray gun in fluid communication with the pump to receive pressurized fluid from the pump, the spray gun including an outlet portion that selectively connects to the housing to direct the pressurized fluid from the pump into the elongated tube of the spray assembly, wherein, when the outlet portion is disconnected from the housing, the spray gun discharges the pressurized fluid toward the surface without directing the pressurized fluid into the spray assembly.

17. The surface cleaner system of claim 16, wherein the nozzle is coupled to an end portion of the elongated tube substantially opposite the hub.

18. The surface cleaner system of claim 17, wherein the end portion of the elongated tube is bent such that the nozzle discharges the pressurize fluid at an acute angle relative to the axis.

19. The surface cleaner system of claim 16, wherein the spray assembly further includes a second elongated tube extending radially from the hub and a second nozzle coupled to the second elongated tube, wherein the second elongated tube receives pressurized fluid from the pump when the outlet portion of the spray gun is connected to the housing, and wherein the second nozzle discharges the pressurized fluid from the second elongated tube toward the ground surface.

20. The surface cleaner system of claim 16, wherein the nozzle is threadably coupled to the elongated tube.

21. The surface cleaner system of claim 16, wherein, when the outlet portion of the spray gun is connected to the housing, the spray gun functions as a handle for the surface cleaner system to move the housing along the surface.

22. The surface cleaner system of claim 21, wherein the spray gun includes a handle portion defining a hand grip, wherein the handle portion facilitates moving the base assembly along the surface when the outlet portion is connected to the housing, and wherein the handle portion facilitates holding the spray gun when the outlet portion is disconnected from the housing.

23. The surface cleaner system of claim 16, wherein the outlet portion of the spray gun includes a quick-connect coupling and the housing includes an inlet coupling in communication with the spray assembly, and wherein the quick-connect coupling engages the inlet coupling to connect the outlet portion to the housing and direct pressurized fluid from the spray gun into the elongated tube.

24. The surface cleaner system of claim 16, further comprising a hose coupled to the pump and the spray gun, wherein the hose fluidly couples the pump to the spray gun to direct pressurized fluid into the spray gun.

25. The surface cleaner system of claim 16, wherein the pump is supported by the housing.

26. The surface cleaner system of claim 25, further comprising a prime mover supported by the housing, wherein the prime mover is coupled to the pump to drive the pump.

27. The surface cleaner system of claim 26, wherein the prime mover is an electric motor.

28. The surface cleaner system of claim 16, wherein the at least one wheel includes a first wheel and a second wheel, wherein the first wheel is coupled to the housing and extends outwardly beyond a periphery of the housing, and wherein the second wheel is coupled to the housing adjacent to the first wheel and is positioned inwardly of the periphery of the housing.

* * * * *